US007291793B2

(12) United States Patent
Hecht

(10) Patent No.: US 7,291,793 B2
(45) **Date of Patent: *Nov. 6, 2007**

(54) MULTIFUNCTION KEY ASSEMBLY

(75) Inventor: Gil Hecht, 30/18 Ahad Ha'am Street, 22443 Nahariya (IL)

(73) Assignees: Iscar Ltd., Tefen (IL); Gil Hecht, Nahariya (IL)

( * ) Notice: Subject to any disclaimer, the term of this patent is extended or adjusted under 35 U.S.C. 154(b) by 274 days.

This patent is subject to a terminal disclaimer.

(21) Appl. No.: 11/090,797

(22) Filed: Mar. 25, 2005

(65) Prior Publication Data

US 2005/0269190 A1 Dec. 8, 2005

(30) Foreign Application Priority Data

Jun. 2, 2004 (IL) ..... 162307

(51) Int. Cl.
*H01H 9/54* (2006.01)

(52) U.S. Cl. ..... 200/1 R; 200/5 R; 200/17 R

(58) Field of Classification Search ..... 200/1 R, 200/4, 5 R, 5 A, 6 A, 329, 17 R
See application file for complete search history.

(56) References Cited

U.S. PATENT DOCUMENTS

| | | | | |
|---|---|---|---|---|
| 4,894,650 | A | 1/1990 | Krieg | |
| 5,753,874 | A | 5/1998 | Kossakowski | |
| 5,796,056 | A | 8/1998 | Bredow | |
| 6,157,323 | A | 12/2000 | Tso | |
| 6,162,999 | A * | 12/2000 | Ishikawa et al. | 200/6 A |
| 6,344,618 | B1 * | 2/2002 | Sato | 200/6 A |
| 6,441,753 | B1 | 8/2002 | Montgomery | |
| 6,635,832 | B1 * | 10/2003 | Oster et al. | 200/6 A |
| 6,765,165 | B1 * | 7/2004 | Torrens | 200/512 |
| 6,897,391 | B2 * | 5/2005 | Gavalda | 200/512 |

* cited by examiner

*Primary Examiner*—K. Richard Lee
(74) *Attorney, Agent, or Firm*—Womble Carlyle

(57) ABSTRACT

A multifunction key assembly for inputting data to an electronic device. The multifunction key assembly has two switches operated by a single key cap. The key cap can be displaced vertically into three active positions and horizontally into four contact positions, giving rise to twelve distinct output data signals for inputting to the electronic device.

21 Claims, 9 Drawing Sheets

MULTIFUNCTION KEY ASSEMBLY

FIELD OF THE INVENTION

The present invention relates to a multifunction key assembly for an electronic device.

BACKGROUND OF THE INVENTION

There is considerable demand for the miniaturization of electronic devices in general and for cellular telephones in particular. On the other hand, there is increasing demand for electronic devices that include more and more features. Invariably, these demands result in a reduction in the display area, that is, the size of the display screen, or of the viewable area. A major reason for this being the necessity of maintaining a conventional keypad matrix arrangement for inputting data. Although the size and the spacing of the buttons that form a conventional keypad matrix arrangement are constantly being reduced as a result of miniaturization, there is a limit to their reduction. Moreover, with small buttons, or closely spaced buttons, there is a high likelihood of accidentally depressing an unintended button which is adjacent an intended button, or even simultaneously depressing two adjacent buttons thereby providing false input data. Moreover, since the buttons are depressed one by one for each input data, speed of operation is limited.

U.S. Pat. No. 6,441,753 discloses a multifunction key assembly for electronic devices. The multifunction key assembly has a button member having an upper contoured surface defining nine key regions, which in a preferred embodiment, are arranged in a manner consistent with the one through nine keys of a conventional telephone keypad with the central key region representing the five key of a telephone keypad and each perimeter key region represents the remaining keys. However, unlike the conventional keypad matrix the zero, asterisk and pound sign keys are missing. An auxiliary button may be representative of the zero key. Alternatively, each key region may serve multiple functions. For example, the five key region may operate as a conventional zero key upon a double-click. This option is suggested, but its implementation is not described. Whatever the case, the numeral zero cannot be entered through the principal mode of operation and therefore every time a zero that has to be entered will disrupt the smooth flow of data input.

SUMMARY OF THE INVENTION

In accordance with the present invention there is preferably provided a multifunction key assembly comprising:

two switches electrically connected to each other, each switch being capable of giving rise to exactly four distinct output signals when in an electrically on-state;

a single key cap coupled to the two switches, the single key cap being capable of selectively activating the two switches either separately or simultaneously, whereby a total of twelve possible distinct output signals can be outputted from the multifunction key assembly, eight distinct output signals being obtained when each of the two switches is activated separately and four distinct output signals when the two switches are activated simultaneously.

The multifunction key assembly may be located in, or partially located in, an electronic device and the output signals may be used as input data to the electronic device. Generally, the output signals will be electric signals, which may be transformed into other types of signals.

In accordance with a preferred embodiment, the key cap is moveable from a non-active position to an active position by vertically depressing at least a portion of the key cap, wherein in the non-active position both switches are in an electrically off-state and wherein in an active position at least one of the switches is in an electrically on-state, there being a total of three active positions, a first active position corresponding to one of the switches being in an electrically on-state, a second active position corresponding to the other one of the switches being in an electrically on-state and a third active position corresponding to the two switches being simultaneously in an electrically on-state.

It will be appreciated that depressing at least a portion of the key cap defines a direction, which is referred to herein as the vertical direction.

Further in accordance with a preferred embodiment, the key cap is horizontally displaceable in two mutually perpendicular directions to four contact positions. Typically, the two mutually perpendicular directions are termed North-South and East-West and the four contact positions are, in clockwise direction, North, East, South and West. The two mutually perpendicular directions are coplanar and perpendicular to the vertical direction in which the at least a portion of the key cap is depressed.

Yet further in accordance with a preferred embodiment, for each combination of a given contact position and a particular active position of the key cap, a specific distinct output signal of the twelve possible distinct output signals is outputted by the multifunction key assembly.

In accordance with a first preferred embodiment, each switch comprises a single electrically conducting stem, the keycap being coupled to the stem of each switch.

In accordance with another preferred embodiment, each switch further comprises an electrically non-conducting guide member, the guide member having two throughgoing guide grooves perpendicular to each other forming a cross-shaped aperture.

Typically, each end of the two guide grooves is provided with an electrical contact. Since there are two guide grooves perpendicular to each other forming a groove in the shape of a cross, there will be four ends and therefore four electrical contacts. A contact position is obtained when a part of the at least one of the switches is in electrical abutment with a given electrical contact.

In accordance with one preferred embodiment, the stem of each switch passes through the grooves of an associated guide member and the part of the at least one of the switches which is in electrical abutment with one of four electrical contacts is the stem of the at least one of the switches.

In accordance with a second preferred embodiment, the key cap is coupled to a single centrally located electrically conducting stem.

In accordance with a preferred embodiment, the single stem passes through a single cross-shaped aperture in a single electrically non-conducting guide member, the aperture comprising two throughgoing guide grooves perpendicular to each, with electrical contacts being located at each end of each guide groove, there being in all four electrical contacts, wherein a given contact position is obtained when the stem is in electrical abutment with a given electrical contact.

There is also provided in accordance with the present invention a method for providing one of twelve distinct output signals, preferably comprising the steps of:

(a) providing a multifunction key assembly comprising two switches electrically connected to each other and coupled to a single key cap;

(b) vertically displacing the key cap from a non-active position to an active position by depressing at least a portion of the key cap, wherein in the non-active position both switches are in an electrically off-state and wherein in an active position at least one of the switches is in an electrically on-state; and (c) horizontally displacing the key cap in one of two mutually perpendicular directions to one of four contact positions, thereby providing the one of the twelve distinct output signals.

The order of carrying out the steps of the method does not have to be in accordance with the order given above. For example, if desired, step (c) can be carried out before step (b).

The present invention provides the following potential advantages over conventional technologies:

It facilitates the miniaturization of electronic devices in general and cellular telephones in particular.

It enables the use of larger display screens.

The multifunction key is operated by a single key cap.

The single key cap may be operated by the thumb of one hand of an operator.

The single key cap is simple to operate. Twelve distinct output signals can be obtained by displacing the key cap horizontally in two mutually perpendicular directions (North-South, East-West) in combination with depressing the key cap at three different regions thereof.

Other advantages of the present invention are readily apparent to those skilled in the art from the following figures, description, and claims.

In another aspect, the present invention is directed to a cellular telephone incorporating such a multifunction key assembly.

BRIEF DESCRIPTION OF THE DRAWINGS

For a better understanding of the present invention and to show how the same may be carried out in practice, reference will now be made to the accompanying drawings, in which.

DETAILED DESCRIPTION OF THE INVENTION

Figure 1:
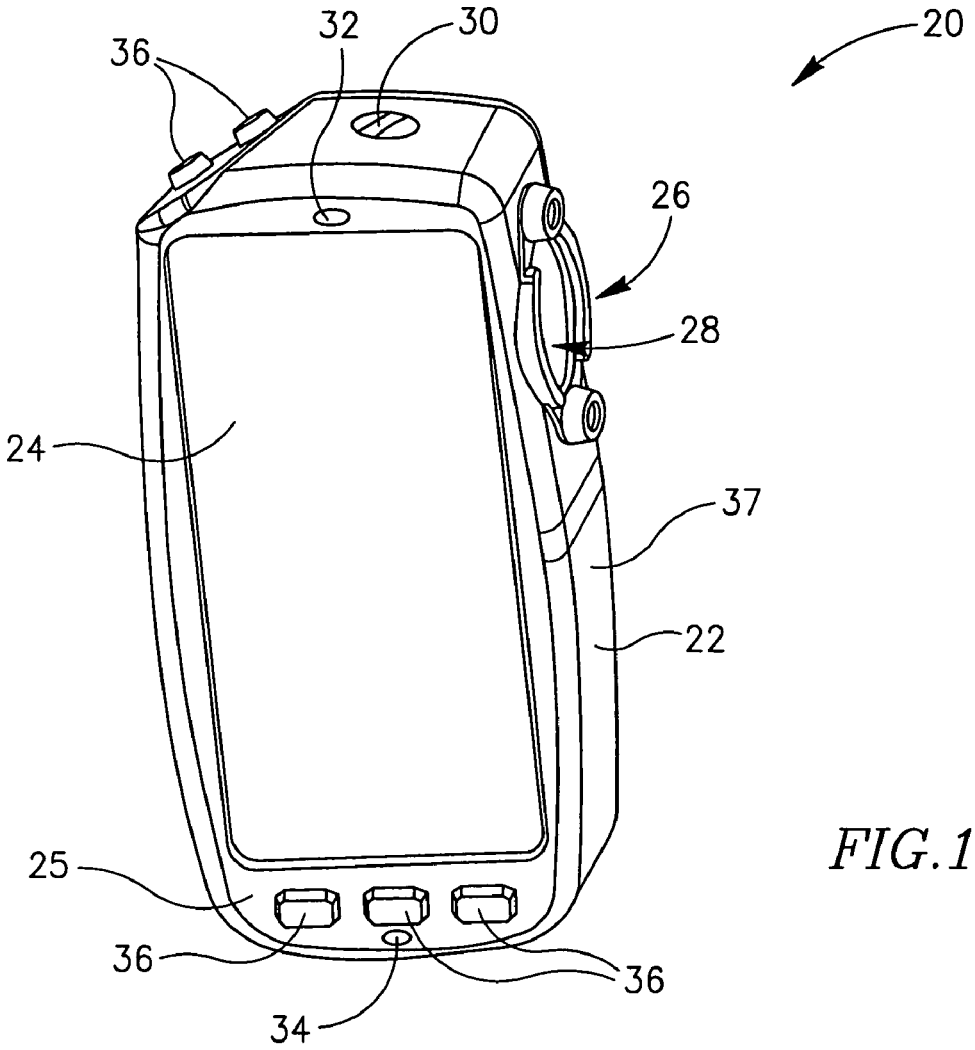
FIG. 1 is a perspective view of a typical cellular telephone with a multifunction key assembly according to the present invention.

Attention is drawn to FIG. 1 showing a typical electronic device 20 in accordance with the present invention. A non-binding example of such an electronic device 20 as illustrated in FIG. 1 is a cellular telephone. The electronic device 20 comprises a casing 22, a display screen 24 on a front surface 25 of the casing 22, a multifunction key assembly 26 in accordance with the present invention having a key cap 28, a loudspeaker 30, an earphone 32, a microphone 34 and auxiliary keys 36. Noticeably missing is the conventional keypad for inputting data to the electronic device 20. Moreover, the multifunction key assembly 26 of the present invention is much smaller than the conventional keypad and therefore may be positioned within the electronic device 20 in such a manner that the key cap 28 is located on a side surface 37 of the casing 22 of the electronic device 20, thereby freeing the great majority of space of the front surface 25 for the display screen 24, as shown in FIG. 1.

Figure 2:
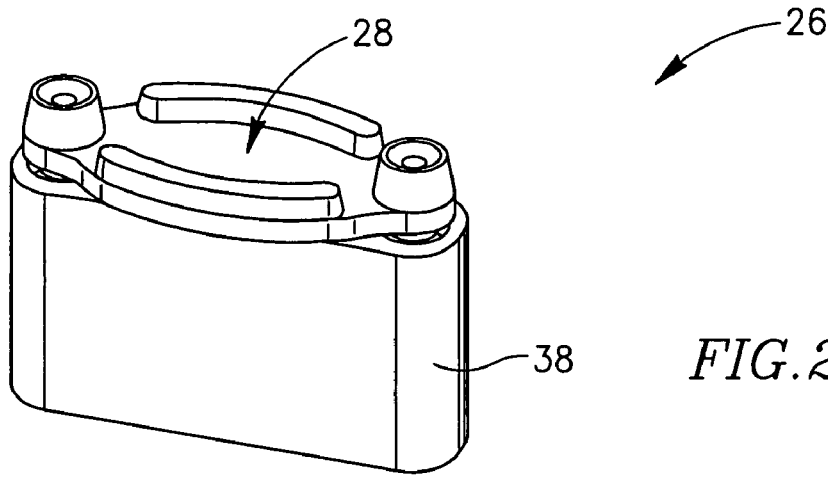
FIG. 2 is a perspective view of a multifunction key assembly module according to the present invention.
Figure 3:
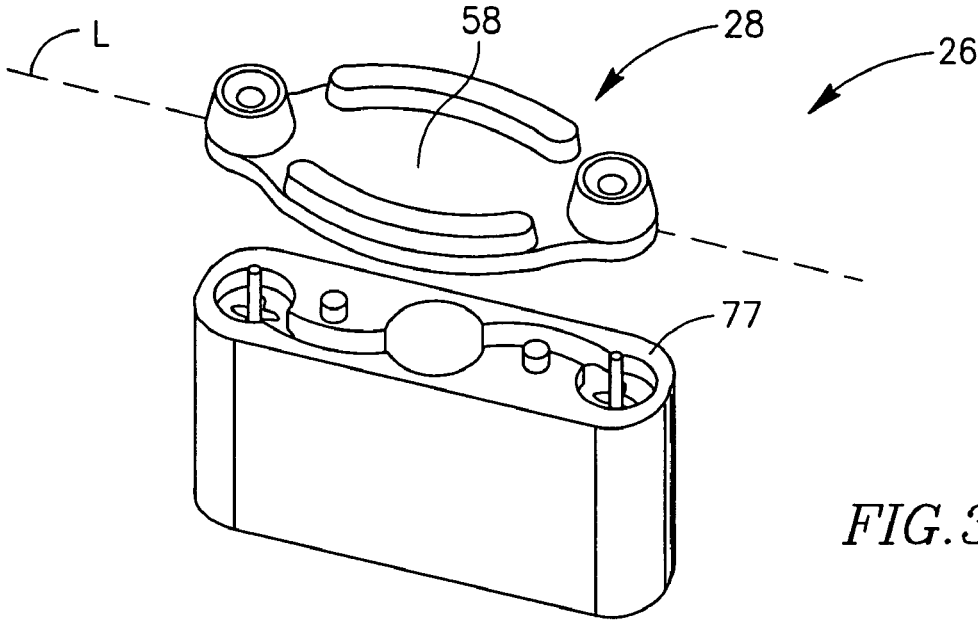
FIG. 3 is a partially exploded view of the multifunction key assembly module of FIG. 2.
Figure 4:
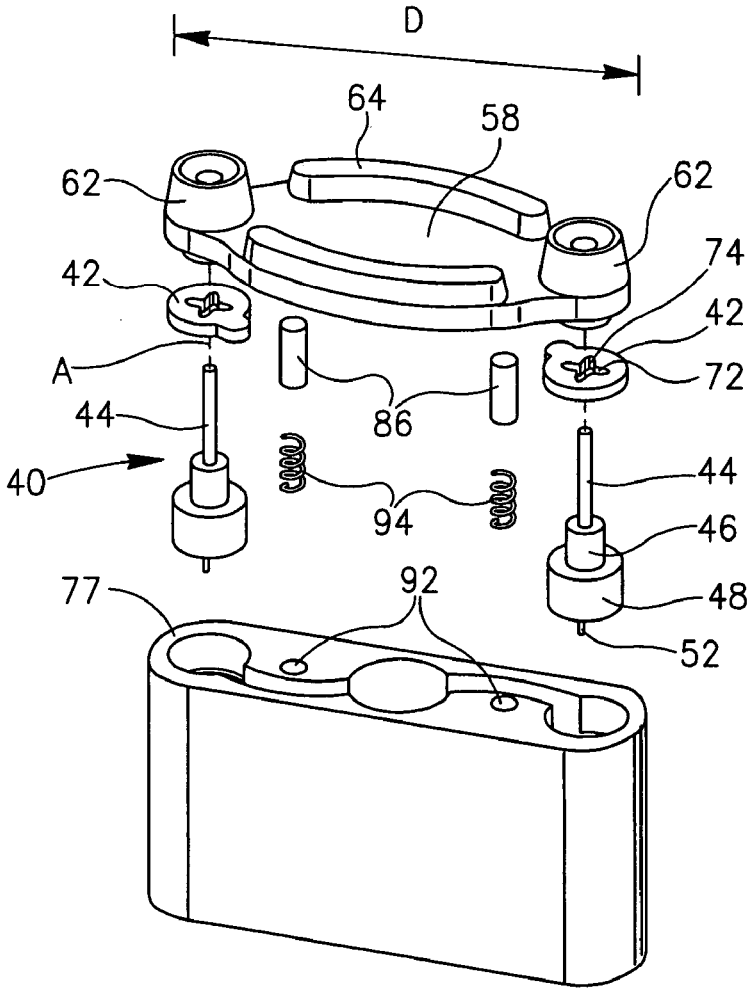
FIG. 4 is a fully exploded view of the multifunction key assembly module of FIG. 2.
Figure 5:
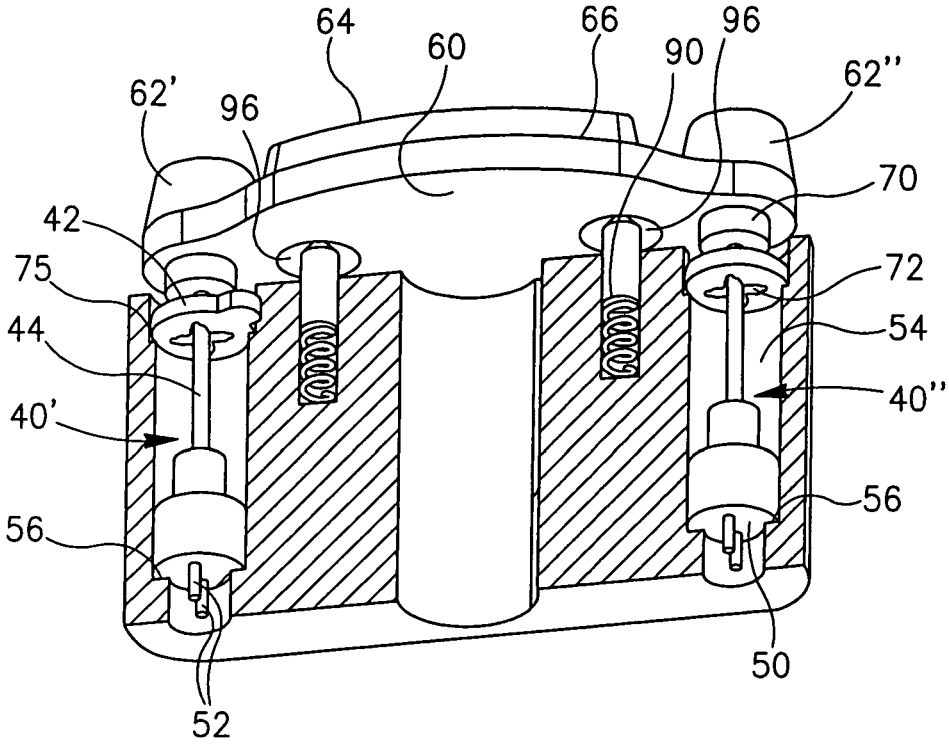
FIG. 5 is a partially sectioned bottom perspective view of the multifunction key assembly module of FIG. 2.
Figure 6:
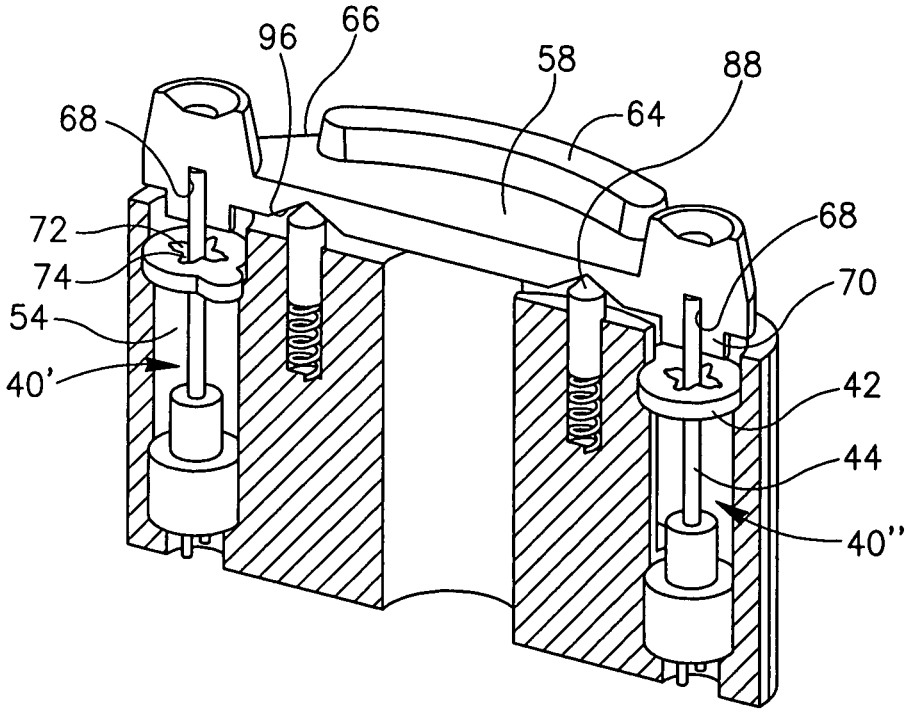
FIG. 6 is a partially sectioned top perspective view of the multifunction key assembly module of FIG. 2.

The multifunction key assembly 26 can be incorporated in the electronic device 20 as an integral part thereof, or it may be manufactured as a separate module and conveniently inserted and removed therefrom as required. The multifunction key assembly 26 in the form of a module is shown in FIG. 2. For convenience of illustration only, the multifunction key assembly 26 in the form of a module will be described. This has no limiting effect on the description of the multifunction key assembly 26, but merely serves to restrict the description to the features of the multifunction key assembly 26, thereby excluding from the description features of the electronic device 20 which are not relevant to the invention.

With reference to FIGS. 3 to 6, the multifunction key assembly 26 comprises, in accordance with a first embodiment of the present invention, in addition to the key cap 28, a housing 38, two switches 40 and two electrically non-conducting guide members 42. Each switch 40 comprises an electrically conducting stem 44 having a longitudinal axis A defining a longitudinal direction of the switch 40, a movable guide cylinder 46 in which one end of the stem 44 is retained and a fixed guide cylinder 48 in which the movable guide cylinder 46 is longitudinally displaceable. Protruding from a lower end 50 of the fixed guide cylinder 48 are two electrically conducting leads 52. It will be appreciated that if the multifunction key assembly 26 is not a separate module but is incorporated in the electronic device 20 as an integral part thereof, then the housing 38 of the multifunction key assembly 26 will be a part of the casing 22 of the electronic device 20.

Each switch 40 and an associated guide member 42 is located in a chamber 54 in the housing 38 having a lower step 56 which abuts the lower end 50 of the fixed guide cylinder 48, thereby supporting the switch 40 against longitudinal forces applied to the stem 44 by the key cap 28.

The key cap 28 has opposing upper and lower surfaces 58, 60 and has a generally elongated oval or elliptical shape having a long dimension D defining a longitudinal axis L of the key cap 28. Two push buttons 62 project from the upper surface 58 of the key cap 28 at ends of the key cap 28, that is, at extremities of the long dimension D of the key cap 28. In addition, two opposing elongated projections 64 project from the upper surface 58, extending adjacent long edges 66 of the key cap 28 on opposite sides of the longitudinal axis L. The end of each stem 44 distal the movable guide cylinder 46 is retained in a bore 68 passing through a cylindrical protrusion 70 protruding from the lower surface 60 of the key cap 28 directly below an opposing push button 62, thereby mechanically connecting the key cap 28 to the switches 40.

Each guide member 42 has two throughgoing guide grooves 72, 74 perpendicular to each other forming a cross-shaped aperture. The guide member 42 is supported in the chamber 54 by an upper step 75 and has a small protrusion 42' which is located in a recess 76 in the housing 38, in order to fix the orientation of the guide grooves 72, 74. The stem 44 of each switch 40 passes through the guide grooves 72, 74 of an associated guide member 42 so that the guide member 42 is located between the movable guide cylinder 46 and the key cap 28. The end of each stem 44 distal the movable guide cylinder 46 protrudes beyond a top surface 77 of the housing 38 and the lower surface 60 of the key cap 28 is adjacent and opposite the top surface. Generally, the top surface 77 is an outer surface of the housing 38 of the multifunction key assembly module. However, if the multifunction key assembly 26 is incorporated in the electronic device 20 as an integral part thereof, then the top surface will be part of the external surface of the casing 22 of the electronic device 20.

Figure 7:
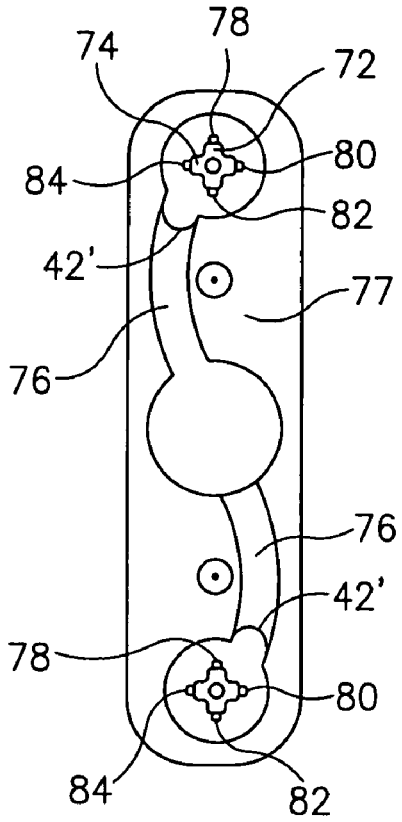
FIG. 7 is a top view of the multifunction key assembly module of FIG. 2 with key cap in a non-active position.

One of the guide grooves 72 of each guide member 42 is aligned with the longitudinal axis of the key cap 28 and will be referred to herein as the longitudinal guide groove. The other one of the guide grooves 74 of each guide member 42 is perpendicular to the longitudinal axis of the key cap 28 and will be referred to herein as the transverse guide groove. At the ends of the longitudinal and transverse grooves 72, 74 are electrical contacts 78, 80, 82, 84. Consequently, all in all there are four electrical contacts 78, 80, 82, 84 associated with the guide grooves of each guide member 42. These will be labeled first, second, third and fourth electrical contacts 78, 80, 82, 84, as shown in FIG. 7.

As will described in greater detail below, the key cap 28 can be moved in various directions by applying an external force to it. In general, an external force is applied to the key cap 28 by an operator placing a thumb on the upper surface 58 of the key cap 28, or on one of the push buttons 62 and then either depressing the key cap 28 and displacing it "vertically" by applying a force in the longitudinal direction of the switches 40, or displacing the key cap 28 "horizontally" by applying a force in a direction perpendicular to the longitudinal direction of the switches 40. In addition, both vertical and horizontal forces can be applied simultaneously. The stems 44 are preferably resilient to allow sufficient horizontal displacement of the key cap 28.

If no vertical force is applied to the key cap 28, then the key cap 28 is said to be in a non-active state. If no external force at all is applied to the key cap 28, then the key cap 28 is said to be in its rest position.

Since the stems 44 are constrained to move in the guide grooves 72, 74, the horizontal displacement of the key cap 28 is constrained to move longitudinally and transversely, corresponding to movement of the stems 44 in the longitudinal and transverse guide grooves 72, 74, respectively. In other words, the key cap 28 can be displaced horizontally in two mutually perpendicular directions.

Figure 8:
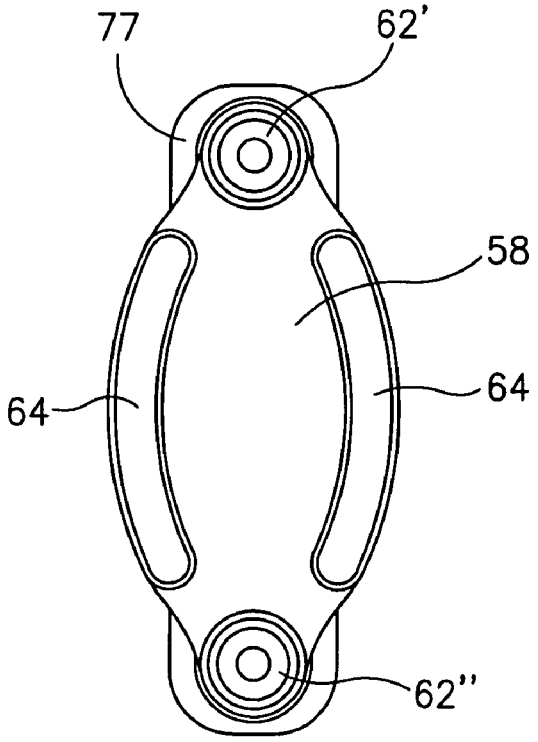
FIG. 8 is a top view of the multifunction key assembly module of FIG. 2 with key cap in a non-active position.
Figure 9A:
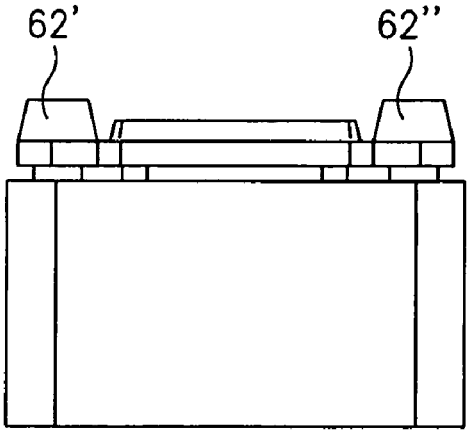
FIG. 9A is a side view of the multifunction key assembly module of FIG. 2 with key cap in a non-active position.

Two support pins 86 are provided. Although not absolutely necessary, the support pins 86 aid in restoring the key cap 28 to its rest position (FIGS. 8 and 9A) after having been displaced and the external force is removed. The support pins 86 have conical protrusions 88 at one end and flat surfaces 90 at the other end. The support pins 86 are located in cavities 92 in the housing 38 and are biased by means of helical springs 94 located in the cavities 92 below the support pins 86 and in contact with the flat surfaces 90. The conical protrusions 88 are received in conical indents 96 in the lower surface 60 of the key cap 28.

When the key cap 28 is displaced vertically by depressing it, it is displaced from its rest position, or from a non-active position, (FIG. 9A), to an active position. There are precisely three active positions. A first active position (FIG. 9B) is obtained by displacing a first end of the key cap 28 vertically, that is, by depressing a first of the push buttons 62' so that only the stem 44 coupled to the first push button 62' is displaced vertically thereby changing the electrical state of the of the first switch 40' from an off-state (electrically non-conducting) to an on-state (electrically conducting). A second active position (FIG. 9C) is obtained by displacing a second push button 62" end of the key cap 28 vertically, that is, by depressing the second push button 62" so that only the stem 44 coupled to the second push button 62" is displaced vertically thereby changing the electrical state of the of the second switch 40" from an off-state to an on-state. A third active position (FIG. 9D) is obtained by displacing the whole of the key cap 28 vertically, that is, by depressing the upper surface 58 of the key cap 28 at a location between the two push buttons 62 so that both stems 44 are displaced vertically thereby changing the electrical state of both switches 62 from an off-state to an on-state.

After the key cap 28 has been moved to a given active position by depressing it vertically, an output signal can be obtained by moving the key cap 28 to a particular contact position. This is achieved by retaining the key cap 28 in the given active position and displacing it horizontally either longitudinally or transversely until the stem 44, that is, a part of the switch 40, comes into electrical contact with one of the four electrical contacts 78, 80, 82, 84 of the guide grooves 72, 74. A distinct output signal is obtained for each combination of a given active position and a particular contact position. The elongated projections 64 serve to prevent the operator's thumb from slipping when displacing the key cap 28 horizontally and when the operator's thumb is at a location between the two push buttons 62.

Since there are three active positions (FIG. 9B, FIG. 9C and FIG. 9D) and four contact positions (corresponding to the first, second, third and fourth electrical contacts, 78, 80, 82, 84), a total of twelve distinct output signals can be obtained. As a non-binding example, one could choose these twelve distinct output signals to represent the 10 numerals 1, 2, 3, 4, 5, 6, 7, 8, 9, 0 and the functions "clear" and "back space". Which particular combinations of active positions and contact positions are used to represent these twelve outputs is a matter of choice. As a non-binding example, the four output signals for the numerals 1, 2, 3 and 4, defining a first set of outputs, may be obtained using the first active position (FIG. 9B) along with the first, second, third and fourth contact positions, respectively; the four output signals for the numerals 5, 6, 7 and 8, defining a second set of outputs, may be obtained using the second active position (FIG. 9C) along with the first, second, third and fourth contact positions, respectively; and the four output signals for the two numerals 9, 0, and the two functions "clear" and "back space", defining a third set of outputs, may be obtained using the third active position (FIG. 9C) along with the first, second, third and fourth contact positions, respectively.

Figure 9B:
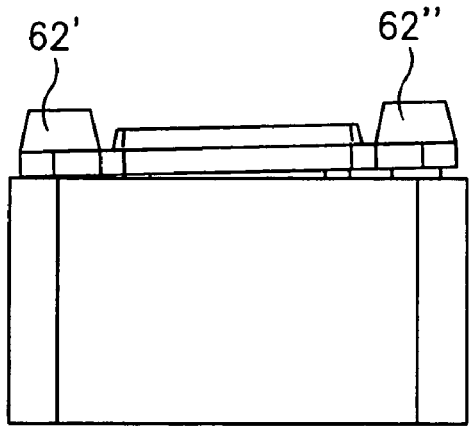
FIG. 9B is a side view of the multifunction key assembly module of FIG. 2 with key cap in a first active position.
Figure 9C:
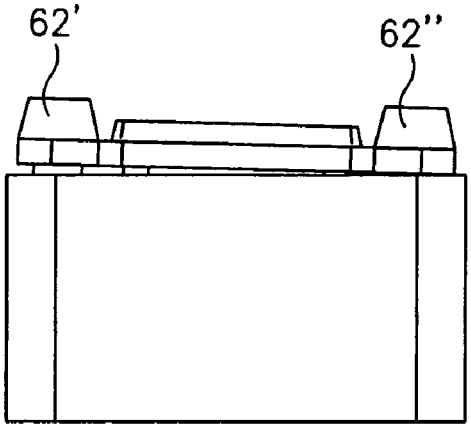
FIG. 9C is a side view of the multifunction key assembly module of FIG. 2 with key cap in a second active position.
Figure 9D:
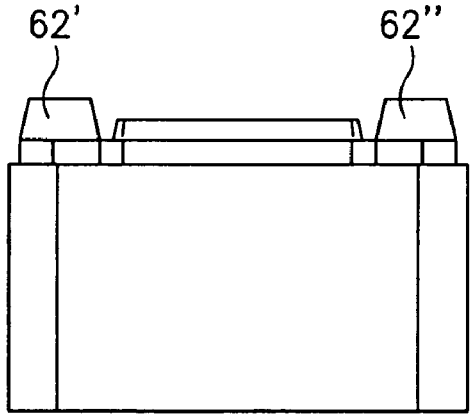
FIG. 9D is a side view of the multifunction key assembly module of FIG. 2 with key cap in a third active position.
Figure 10:
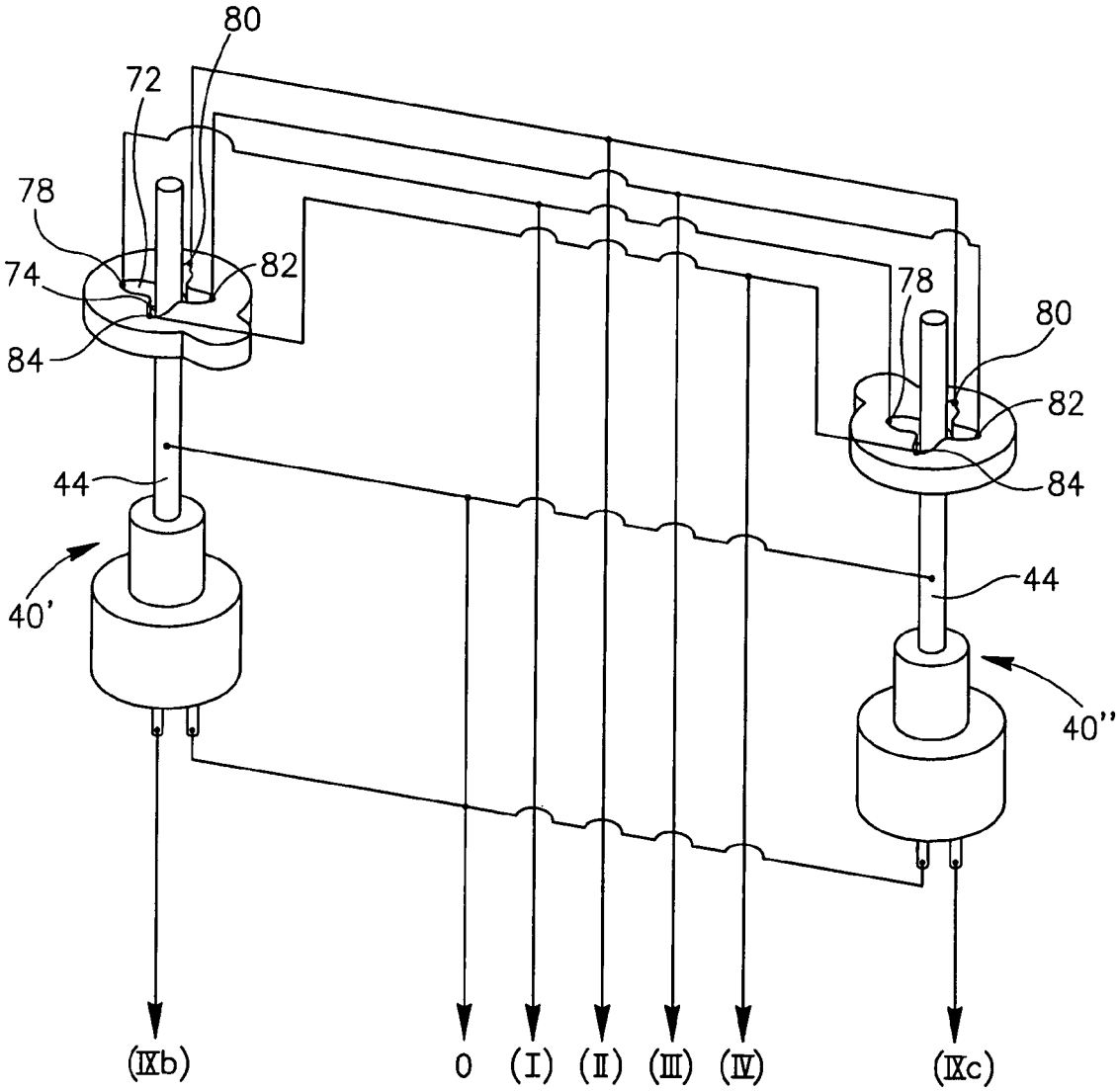
FIG. 10 is an illustrative view of one possible arrangement of the electrical wiring of the multifunction key assembly in accordance with the first embodiment.

Reference is now made to FIG. 10 showing an illustrative view of one possible arrangement for the electrical wiring of the two switches 40 and their respective guide members 42 that will enable the multifunction key assembly 26 to provide the output signals mentioned above. The stems 44 are electrically common and grounded along with one of the electrically conducting leads 52 of each switch 40. Also, the first, second, third and fourth electrical contacts 78, 80, 82, 84 of one of the two guide members 42 are electrically common with the first, second, third and fourth electrical contacts 78, 80, 82, 84, respectively, of the other one of the two guide members 42. For illustrative purposes, the first, second, third and fourth contact positions, are denoted by (I), (II), (III) and (IV), respectively, and the first and second active positions are denoted by (IXb) and (IXc), respectively. With this notation, in accordance with the example given above, the output signal for the numeral 1, from the first set of outputs, is given symbolically by the combination (Ixb)+(I), that is, the first push button 62' is depressed, so that the first switch 40' is in an on-state, as shown in FIG. 9B and the key cap 28 is in the first contact position. Similarly, the output signal for the numeral 5, from the second set of outputs, is given symbolically by the combination (IXc)+(I), that is, the second push button 62" is depressed, so that second switch 40" is in an on-state, as shown in FIG. 9C and the key cap 28 is in the first contact position. In order to obtain an output signal from the third set of output signals, both switches 40 have to be in an on-state, that is, both push buttons 62 have to be depressed, as shown in FIG. 9D. For example the output signal for the numeral 9 is given symbolically by the combination (Ixb)+(IXc)+(I).

In order to output other signals, such as letters of the alphabet, the key cap 28 may be "double-clicked" before it is displaced in the manner described above. Alternatively, one or more of the auxiliary keys 36 may be actuated. Therefore, a large amount of information such as numerals, letters, symbols, functions, etc. can be outputted from the multifunction key assembly 26.

In accordance with the first embodiment described above, each of the two switches 40 has a stem 44 and an associated guide member 42. As is clear from the above description of the first embodiment, the stems 44 and guide members 42 are required in order to obtain the four contact positions.

Figure 11:
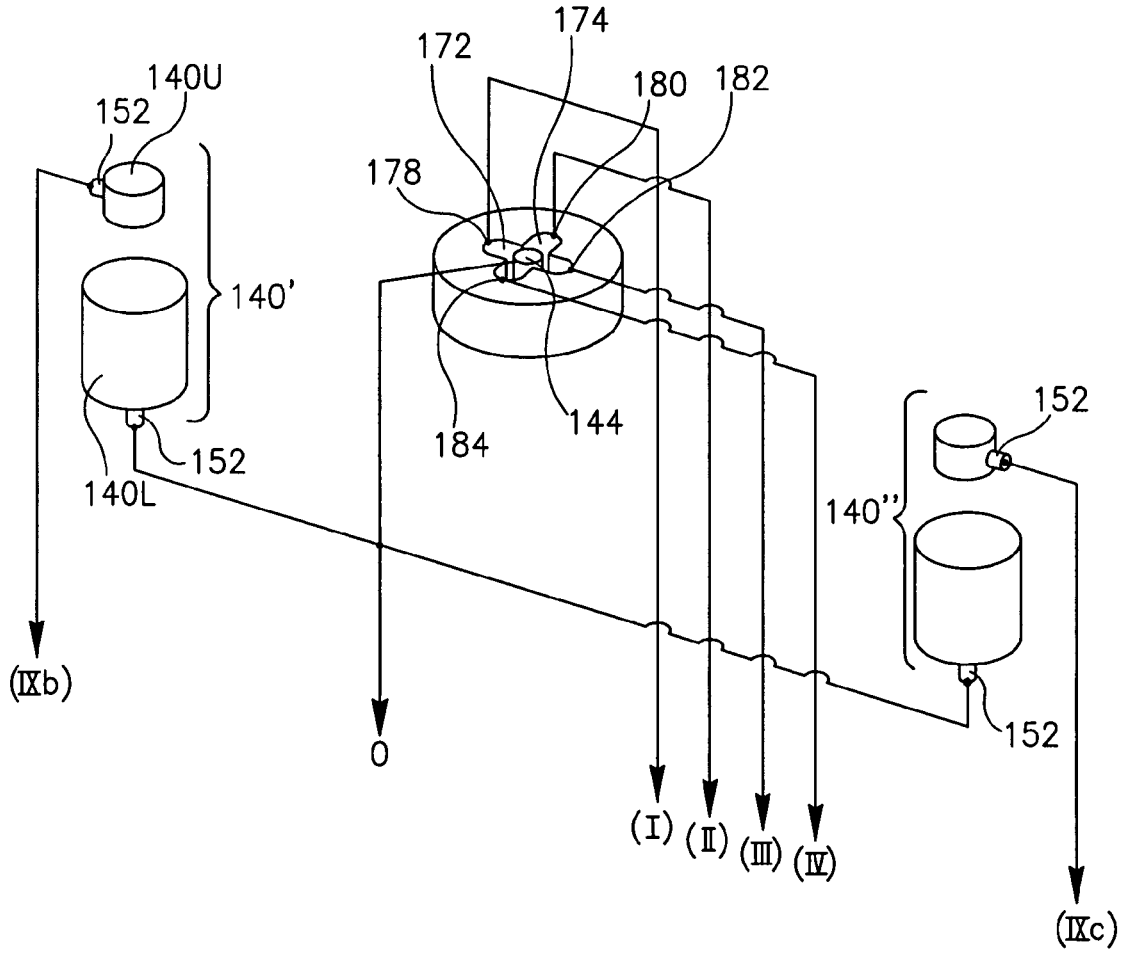
FIG. 11 is an illustrative view of one possible arrangement of the electrical wiring of the multifunction key assembly in accordance with a second embodiment.

With reference to FIG. 11, in accordance with a second embodiment of a multi-function key assembly 126, only one stem 144 and associated guide member 142 is required, the single stem 144 and the single guide member 142 being joint to both switches 140 (140', 140"). The stem 144 is electrically grounded along with one of the leads 152 of each switch 140. As with the first embodiment, the guide member 142 is electrically non-conducting and has a cross-shaped aperture comprising two throughgoing guide grooves 172, 174 perpendicular to each, with electrical contacts 178, 180, 182, 184) being located at each end of each guide groove (172, 174). Consequently, there are all in all four electrical contacts (178, 180, 182, 184). The stem (144) passes through the cross-shaped aperture, and a given contact position is obtained when the stem (144) is in electrical abutment with a given electrical contact (178, 180, 182, 184).

Figure 12:
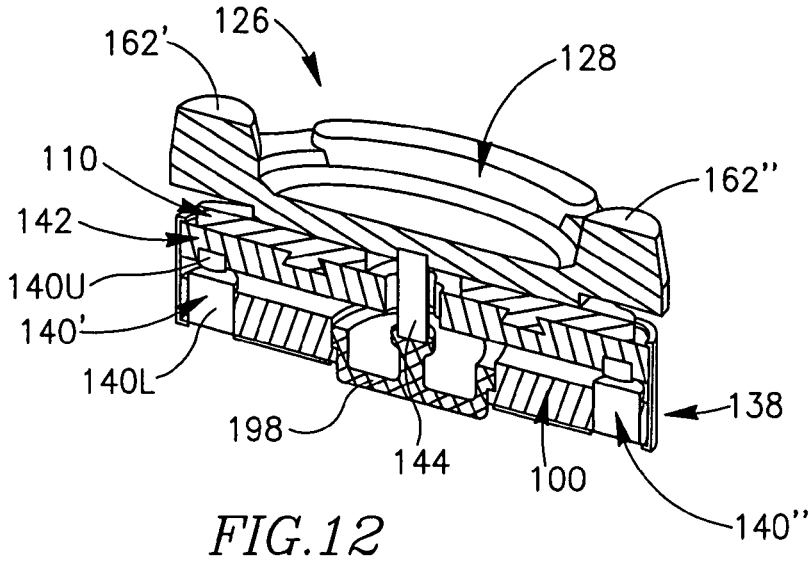
FIG. 12 is a sectioned top view of the multifunction key assembly module in accordance with the second embodiment.
Figure 13:
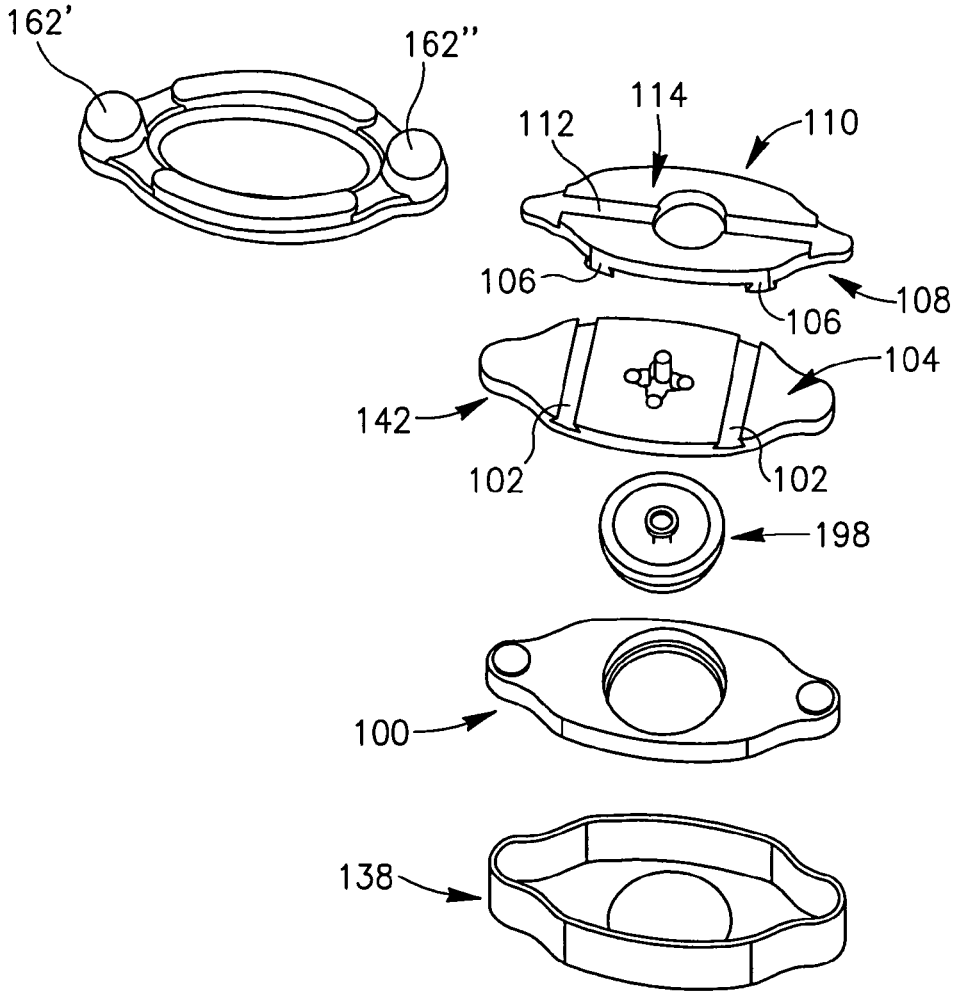
FIG. 13 is a top exploded view of the multifunction key assembly module of FIG. 12.
Figure 14:
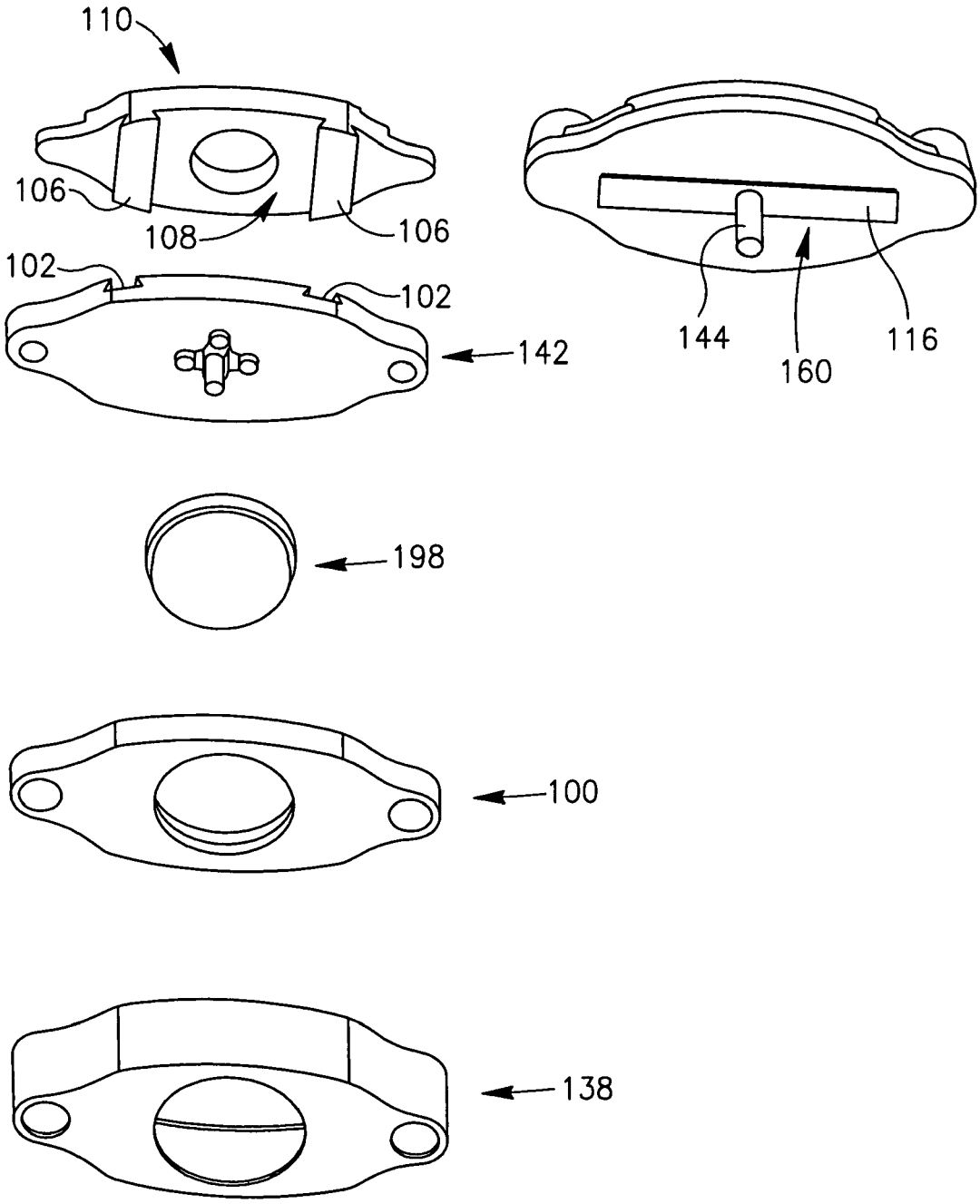
FIG. 14 is a bottom exploded view of the multifunction key assembly module of FIG. 12.

With reference to FIGS. 12 to 14, the key cap 128 is coupled to one end of the single stem 144, which is centrally located with respect to the key cap 128. As in the case of the first embodiment, the key cap 128 has a pair of pushbuttons 162', 162". The other end of the stem 144 is affixed to a flexible holding member 198, which may be made, for example, of rubber. The holding member 198 is located in a base member 100, which in turn is located in the housing 138. The guide member 142 has two transverse grooves 102, in its upper side 104 in which two transverse rails 106, protruding from the lower side 108 of a sliding member 110, are slidingly received. The sliding member 110 has a longitudinal groove 112 in its upper side 114 in which a longitudinal rail 116 protruding from the lower surface 160 of the key cap 128 is slidingly received. Each switch 140 (140', 140") comprise an upper component 140U and a lower component 140L, so that each switch is in an off-state (electrically non-conducting) when a gap exists between the upper and lower components 140U, 140L and in an on-state (electrically conducting) when upper and lower components 140U, 140L contact each other.

The twelve distinct output signals are obtained from the multifunction key assembly 126 of the second embodiment, by applying the same set of operations to the key cap 128 as described for the first embodiment. For example, by depressing the first push button 162' (see FIG. 9B with respect to pushbutton 62'), so that the upper and lower components 140U, 140L of the first switch 140' are brought into contact thereby causing the first switch 140' to be in an on-state, and sliding the key cap to the first contact position (so that the stem 144 is in contact with the first electrical contact 178), the output signal for the numeral 1 is obtained. As with the first embodiment, this is given symbolically by the combination (Ixb)+(I). Similarly, the other eleven distinct output signals are obtained as described above for the first embodiment.

Although the present invention has been described to a certain degree of particularity, it should be understood that various alterations and modifications could be made without departing from the scope of the invention as hereinafter claimed. In particular, the present invention has been described with reference to a cellular telephone. However, it will be appreciated that the present invention is also amenable to other like electronic devices.

What is claimed is:

1. A multifunction key assembly comprising:

two switches electrically connected to each other, each switch being capable of giving rise to exactly four distinct output signals when in an electrically on-state;

a single key cap coupled to the two switches, the single key cap being capable of selectively activating the two switches either separately or simultaneously, whereby a total of twelve possible distinct output signals can be outputted from the multifunction key assembly, eight distinct output signals being obtained when each of the two switches is activated separately and four distinct output signals when the two switches are activated simultaneously.

2. The multifunction key assembly according to claim 1, wherein the key cap is moveable from a non-active position to an active position by vertically depressing at least a portion of the key cap, wherein in the non-active position both switches are in an electrically off-state and wherein in an active position at least one of the switches is in an electrically on-state, there being a total of three active positions, a first active position corresponding to one of the switches being in an electrically on-state, a second active position corresponding to the other one of the switches being in an electrically on-state and a third active position corresponding to the two switches being simultaneously in an electrically on-state.

3. The multifunction key assembly according to claim 2, wherein the key cap is horizontally displaceable in two mutually perpendicular directions to four contact positions.

4. The multifunction key assembly according to claim 3, wherein for each combination of a given contact position and a particular active position of the key cap, a specific distinct output signal of the twelve possible distinct output signals is outputted by the multifunction key assembly.

5. The multifunction key assembly according to claim 4, wherein each switch comprises a single electrically conducting stem and wherein the keycap is coupled to the stem of each switch.

6. The multifunction key assembly according to claim 5, wherein each switch comprises an electrically non-conducting guide member, the guide member having two throughgoing guide grooves perpendicular to each other forming a cross-shaped aperture, each end of the two guide grooves being provided with an electrical contact, a given contact position being obtained when a part of the at least one of the switches is in electrical abutment with a given electrical contact.

7. The multifunction key assembly according to claim 6, wherein the stem of each switch passes through the grooves of an associated guide member and wherein the part of the at least one of the switches which is in electrical abutment with one of four electrical contacts is the stem of the at least one of the switches.

8. The multifunction key assembly according to claim 4, wherein the key cap is coupled to a single centrally located electrically conducting stem.

9. The multifunction key assembly according to claim 8, wherein the single stem passes through a single cross-shaped aperture in a single electrically non-conducting guide member, the aperture comprising two throughgoing guide grooves perpendicular to each, with electrical contacts being located at each end of each guide groove, there being in all four electrical contacts, wherein a given contact position is obtained when the stem is in electrical abutment with a given electrical contact.

10. The multifunction key assembly according to claim 1, wherein there are exactly two switches that are connected to each other.

11. A method for providing one of twelve distinct output signals comprising the steps of:

(a) providing a multifunction key assembly comprising two switches electrically connected to each other and coupled to a single key cap;

(b) vertically displacing the key cap from a non-active position to an active position by depressing at least a portion of the key cap, wherein in the non-active position both switches are in an electrically off-state and wherein in an active position at least one of the switches is in an electrically on-state; and (c) horizontally displacing the key cap in one of two mutually perpendicular directions to one of four contact positions, thereby providing the one of the twelve distinct output signals.

12. A cellular telephone comprising:

a casing having a plurality of surfaces;

a display screen; and a multifunction key assembly comprising:

two switches electrically connected to each other, each switch being capable of outputting exactly four distinct output signals when in an electrically on-state;

a single key cap coupled to the two switches, the single key cap being capable of selectively activating the two switches either separately or simultaneously, whereby a total of at least twelve possible distinct output signals can be outputted from the multifunction key assembly, eight distinct output signals being obtained when each of the two switches is activated separately and four distinct output signals when the two switches are activated simultaneously.

13. The cellular telephone according to claim 12, wherein the key cap is moveable from a non-active position to an active position by vertically depressing at least a portion of the key cap, wherein in the non-active position both switches are in an electrically off-state and wherein in an active position at least one of the switches is in an electrically on-state, there being a total of three active positions, a first active position corresponding to one of the switches being in an electrically on-state, a second active position corresponding to the other one of the switches being in an electrically on-state and a third active position corresponding to the two switches being simultaneously in an electrically on-state.

14. The cellular telephone according to claim 13, wherein the key cap is horizontally displaceable in two mutually perpendicular directions to four contact positions.

15. The cellular telephone according to claim 14, wherein for each combination of a given contact position and a particular active position of the key cap, a specific distinct output signal of the twelve possible distinct output signals is outputted by the multifunction key assembly.

16. The cellular telephone according to claim 12, wherein each switch comprises a single electrically conducting stem and wherein the keycap is coupled to the stem of each switch.

17. The cellular telephone according to claim 16, wherein each switch comprises an electrically non-conducting guide member, the guide member having two throughgoing guide grooves perpendicular to each other forming a cross-shaped aperture, each end of the two guide grooves being provided with an electrical contact, a given contact position being obtained when a part of the at least one of the switches is in electrical abutment with a given electrical contact.

18. The cellular telephone according to claim 17, wherein the stem of each switch passes through the grooves of an associated guide member and wherein the part of the at least one of the switches which is in electrical abutment with a given electrical contact is the stem of the at least one of the switches.

19. The cellular telephone according to claim 12, wherein the key cap is coupled to a single centrally located electrically conducting stem.

20. The cellular telephone according to claim 19, wherein the single stem passes through a single cross-shaped aperture in a single electrically non-conducting guide member, the aperture comprising two throughgoing guide grooves perpendicular to each, with electrical contacts being located at each end of each guide groove, there being in all four electrical contacts, wherein a given contact position is obtained when the stem is in electrical abutment with a given electrical contact.

21. The cellular telephone according to claim 12, wherein the display screen is located on a front surface of the casing and the key cap is located on a side surface of the casing.

* * * * *